United States Patent [19]

Keane et al.

[11] 4,403,372

[45] Sep. 13, 1983

[54] VACUUM CLEANER BRUSH HAVING STRING GUARD MEANS

[75] Inventors: James W. Keane, White Bear Lake; Erwin E. Nordeen, St. Paul, both of Minn.

[73] Assignee: Whirlpool Corporation, Benton Harbor, Mich.

[21] Appl. No.: 351,233

[22] Filed: Feb. 22, 1982

[51] Int. Cl.[3] ..... A47L 9/00

[52] U.S. Cl. ..... 15/339; 15/391

[58] Field of Search ..... 15/339, 391, 392, 389

[56] References Cited

U.S. PATENT DOCUMENTS

| | | | |
|---|---|---|---|
| 1,972,745 | 9/1934 | Martinet | 15/392 X |
| 1,973,679 | 9/1934 | Bass | 15/392 X |
| 2,260,235 | 10/1941 | Smellie . | |
| 3,608,333 | 9/1971 | Webb Selley et al. | 15/389 X |
| 3,802,026 | 4/1974 | Crener | 15/392 X |
| 3,874,017 | 4/1975 | Parker | 15/182 |
| 4,209,873 | 7/1980 | Schaefer | 15/182 |

*Primary Examiner*—Chris K. Moore

*Attorney, Agent, or Firm*—Wood, Dalton, Phillips, Mason & Rowe

[57] ABSTRACT

A vacuum cleaner beater brush having string guard means for preventing string picked up by the brush from damaging the bearings and drive for rotating the brush. In the illustrated embodiment, the drive is a cog belt drive with a sprocket associated with the rotatable brush. The ends of the brush are rotatably journaled in bearings carried by the nozzle housing of the vacuum cleaner structure. The string guards are defined by spaces provided in the brush assembly defining zones of minimum energy to which zones the picked-up string tends to migrate in the rotation of the brush. The string guard spaces, in the illustrated embodiment, are defined by annular recesses and shoulders located suitably to prevent movement of the string to the bearings and cog belt drive sprocket.

17 Claims, 9 Drawing Figures

FIG. 1
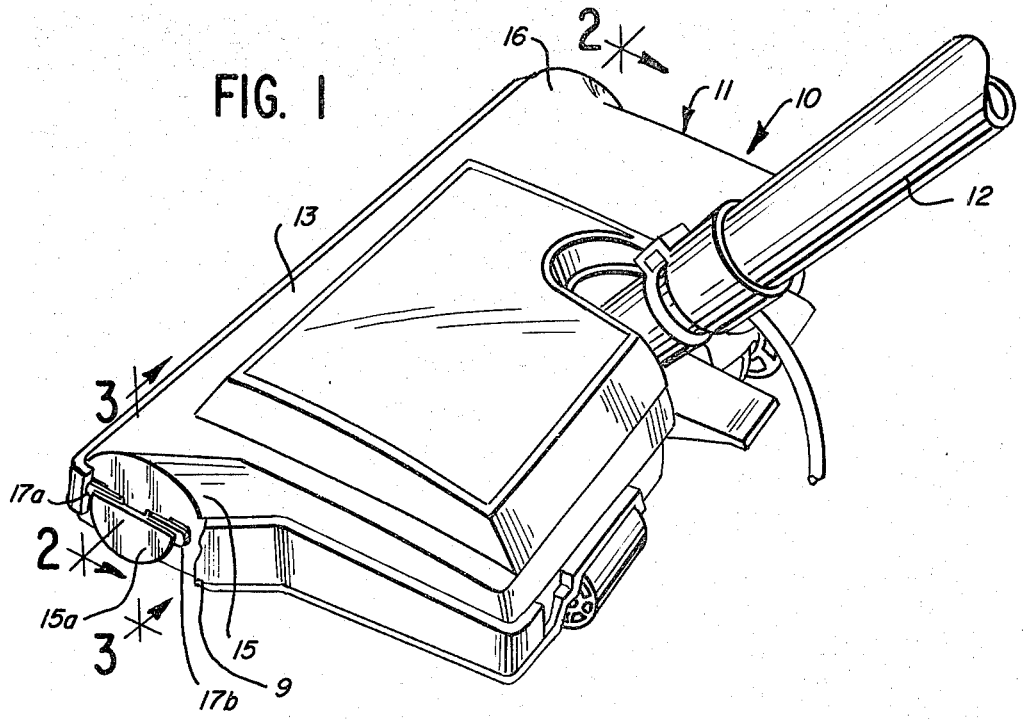
FIG. 2
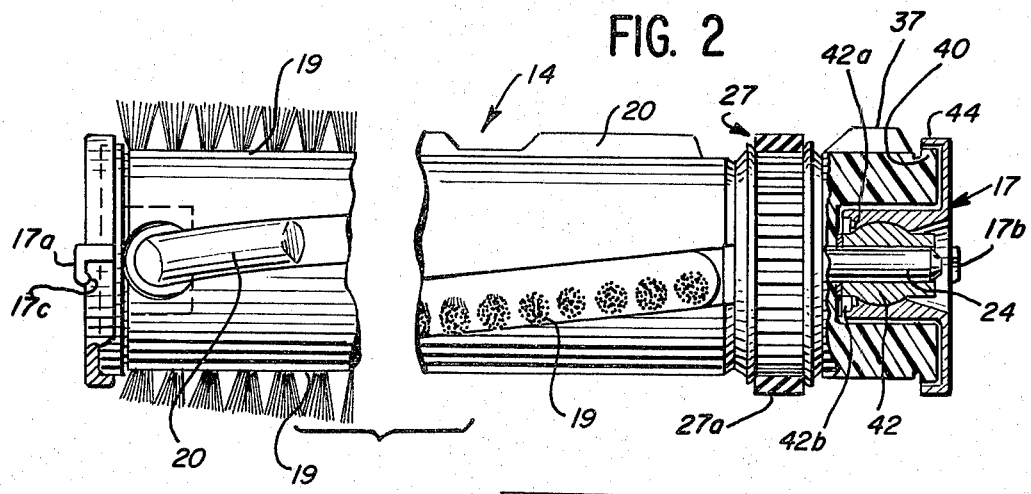
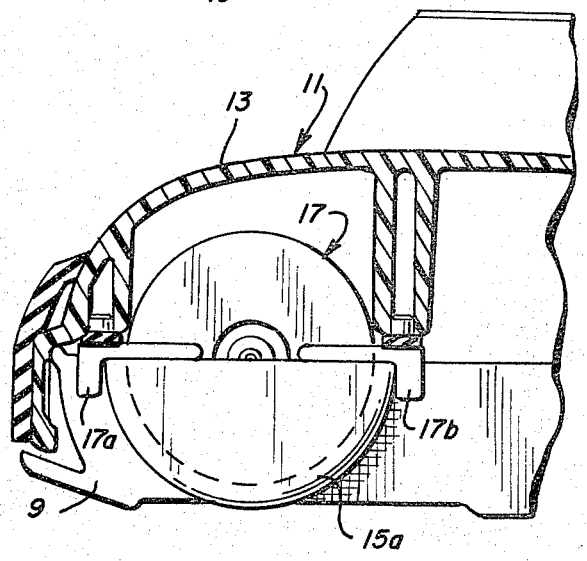
FIG. 3

VACUUM CLEANER BRUSH HAVING STRING GUARD MEANS

BACKGROUND OF THE INVENTION

1. Field of the Invention

This invention relates to vaccum cleaner structures and in particular to beater brush structures for use in vacuum cleaners.

2. Description of the Background Art

It is conventional to provide in vacuum cleaners a suction nozzle having mounted internally thereof driven means for agitating the surface being cleaned, such as a carpet or the like, for improved removal of dirt therefrom. In one form, the dirt-agitating means comprises an agitator in the form of a rotatable brush which is driven by means of a belt or the like, either from the suction fan motor or a separate brush motor.

It is also conventinal to provide in such dirt-agitating devices beater bars or the like comprising relatively rigid projections which are engaged with the surface to be cleaned on rotation of the brush.

In one form, the beater brush is driven rotatively by a cog belt drive having a sprocket associated with the brush assembly driven by a cog belt from a suitable drive motor. One example of such a vacuum cleaner structure is that of Wilbur-Webb Selley et al U.S. Pat. No. 3,608,333.

An example of a dirt-agitator assembly having both brushes and beater elements is that disclosed in U.S. Pat. No. 4,209,873 of Harold W. Schaefer. As shown therein, the roller carrying the brush and beater element is provided with an annular groove for receiving a drive belt to effect rotation thereof, the groove being disposed at an axially midportion of the roller.

It has further been conventional in prior art vacuum cleaner dirt agitators to provide the brush tufts in insert strips mounted to the roller for facilitated manufacture. One example of such a strip-mounted brush structure is that disclosed in U.S. Pat. No. 3,874,017 of Russell H. R. Parker.

A problem encountered in such vacuum cleaner dirt agitators is the entrainment of fibrous material, such as thread material, between movable parts of the system. Thus, as shown in U.S. Pat. No. 2,260,235 of Donald G. Smellie, it is known to provide thread guards in the form of end caps at the opposite ends of the beater brush assembly.

SUMMARY OF THE INVENTION

The present invention comprehends an improved vacuum cleaner beater brush structure, including a dowel carrying a beater brush, a sprocket having teeth adapted to be driven by a cog belt, a carrier provided with brush tufts, and means for securing the carrier to one end of the dowel, with the sprocket retained therebetween. The invention also comprehends the provision of bearing means for rotatably journaling the beater brush structure at opposite ends thereof.

The invention comprehends providing in such a vacuum cleaner beater brush structure improved string guard means for preventing migration of string picked up by the beater brush to the bearings and/or drive belt sprocket.

In the illustrated embodiment, the string guard means is defined by forming spaces in the beater brush structure wherein string received in any of the spaces during rotation of the structure has a lower energy level than that of string adjacent thereto whereby the tendency of the string picked up by the rotating brush to seek its lowest available energy level causes the string to be effectively captured in one of the spaces.

In the illustrated embodiment, the string guard spaces are defined by annular recesses and/or shoulders effectively defining the areas of minimum string energy during rotation of the brush structure.

The invention comprehends the provision of such string guard recesses at opposite ends of the roller brush assembly for preventing migration of string to the bearings.

The invention further comprehends the provision of the string guard means adjacent the drive belt sprocket for preventing migration of string to the sprocket.

The string guard means effectively prevent damage to the vacuum cleaner structure by preventing the movement of the picked-up string into the areas of potential damage during the operation of the vacuum cleaner.

In the illustrated embodiment, the string guard means adjacent the cog belt sprocket further defines cooperating belt retainer flanges for guiding the cog belt into engagement with the sprocket teeth.

In the illustrated embodiment, the sprocket and carrier are provided with interfitted annular shoulders for maintained coaxial disposition thereof.

An axle shaft is mounted to the dowel to project through the sprocket and carrier into a suitable bearing which, in the illustrated embodiment, extends into the carrier.

In broad aspect, the invention comprehends the provision of a vacuum cleaner beater brush structure including a pair of cylindrical elements each having brush tufts projecting radially therefrom, a sprocket adapted to be driven by a cog belt disposed coaxially between the cylindrical elements.

In the illustrated embodiment, one of the cylindrical elements has a length a small fraction of that of the other.

In the illustrated embodiment, the sprocket is defined by a pair of axially abutted elements.

The guide flanges, in the illustrated embodiment, are provided one each of the elements of the pair.

In the illustrated embodiment, the dowel is provided with axle elements projecting coaxially from opposite ends thereof. The axle elements are carried in bearings mounted on the vacuum cleaner base.

The vacuum cleaner beater brush structure and string guard means therefor of the present invention are extremely simple and economical of construction while yet providing an improved beater brush functioning in a vacuum cleaner or the like.

BRIEF DESCRIPTION OF THE DRAWING

Other features and advantages of the invention will be apparent from the following description taken in connection with the accompanying drawing wherein:

FIG. 1 is a fragmentary perspective view of a vacuum cleaner having a beater brush and brush mount structure embodying the invention;

FIG. 2 is a fragmentary enlarged section taken substantially along the line 2—2 of FIG. 1;

FIG. 3 is a fragmentary section taken substantially along the line 3—3 of FIG. 1 illustrating mounting of the brush bearings to the base of the vacuum cleaner nozzle;

DESCRIPTION OF THE PREFERRED EMBODIMENT

Figures 4, 5, 6, 7, 8, 9:
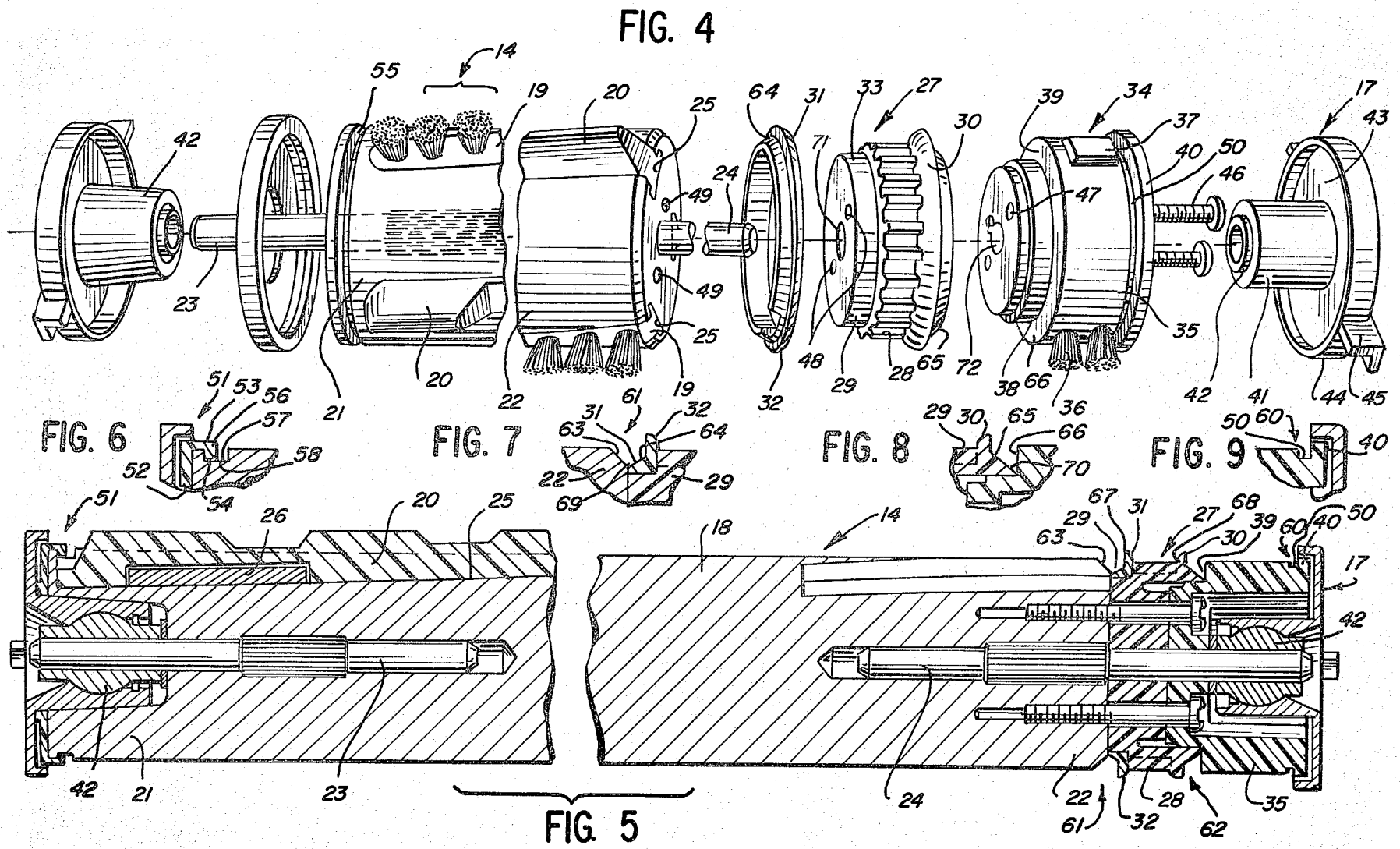
FIG. 4 is an exploded perspective view of the beater brush structure.
FIG. 5 is a broken diametric section of the assembled beater brush structure.
FIG. 6 is a fragmentary section illustrating in greater detail the construction of the string guard at the left-hand end of the beater brush assembly as seen in FIG. 5.
FIG. 7 is a fragmentary sectional view of the string guard at the left side of the cog belt sprocket, as seen in FIG. 5.
FIG. 8 is a fragmentary section of the string guard at the right side of the cog belt sprocket, as seen in FIG. 5.
FIG. 9 is a fragmentary section of the string guard at the righthand end of the beater brush structure, as seen in FIG. 5.

In the illustrative embodiment of the invention as disclosed in the drawing, a vacuum cleaner 10 is provided with a nozzle 11 and a handle 12 swingably mounted to the nozzle. The nozzle includes a cover portion 13 housing an agitator or beater brush structure generally designated 14 embodying the invention, and a base portion 9 to which the beater brush bearings are fastened.

As shown in FIG. 1, the forward portion of nozzle 11 is laterally enlarged so as to permit the beater brush structure 14 to clean an area wider than the rear portion of the nozzle.

The opposite end portions 15 and 16 of the front portion of nozzle 11 are adapted to carry bearing mounts 17 for rotatably journaling the beater brush structure. The bearing mounts 17 include an oil-filled bronze sleeve bearing 42, and a resilient "O"-ring 42*a*, held in place by a ring washer 42*b*. The bearing mount 17 includes a key, not shown, which cooperates with a keyway, not shown, in bearing 42 to prevent turning of the bearing relative to the housing.

The mounting structure for the beater brush structure 14 includes a pair of zinc die cast bearing mounts 17, one being provided on each end of the brush structure 14. Semicircular portions of the base of nozzle 9 are formed to project approximately ⅛" outwardly of the nozzle base at the opposite ends of the bearing mounts 17 to provide recesses to receive the lower halves of the bearing mounts. The bearing mounts 17 include diametrically opposed bearing mount tabs 17*a* and 17*b* that overlap shoulder portions of the nozzle base on each side of the projecting portions 15*a*. The tabs 17*a* and 17*b* include projecting tab ends 17*c* that bite into the plastic base and lock the mounts 17 to the base when the mounts 17 are forced downward on the base causing portions of the base to yield and providing an interference fit.

The beater brush structure includes a roller, or dowel, 18 carrying a plurality of helical brush elements or strips 19 and a helical beater bar element or strip 20. In the illustrated embodiment there are two brush elements and one beater bar element, the respective elements being spaced approximately 120° apart. However, the agitator may also be constructed to include one brush element and one beater bar element, spaced approximately 180° apart.

Projecting from opposite ends 21 and 22 of the dowel 18 is a pair of axles 23 and 24.

The strips 19 and 20 are received in undercut channels 25 in dowel 18 and, as seen in FIG. 4, are provided with complementary cross sections for retention in the channels against centrifugal forces developed in rotation of the dowel about the cylindrical axis thereof, as defined by the axles 23 and 24.

As further shown in FIG. 5, a magnet 26 may be provided in one of the channels 25 subjacent the beater bar strip 20 therein for actuating a magnetic speed sensor or the like. Thus, the magnet may be disposed inwardly of and beneath the beater bar element.

Beater brush structure 14 further includes a sprocket generally designated 27 having teeth 28 adapted to be driven by a cog belt 27*a* or the like. As shown in FIG. 4, the sprocket includes a first portion 29 having teeth 28 formed integrally therewith and defining a belt retainer flange 30 at the axial end of the teeth 28. The sprocket further includes a second flanged ring portion 31 defining a second belt retainer flange 32. Portion 31 is adapted to be received on a cylindrical end 33 of sprocket portion 29 to dispose the flange 32 at the axially opposite side of the toothed array 28 so as to cooperate with opposite flange 30 in retaining the cog belt in alignment with the toothed array.

An edge brush assembly 34 is provided outboard of the sprocket 27 and, as shown in FIG. 4, includes a carrier 35 provided with a plurality of brush tufts 36 and an integral beater bar 37. The carrier is provided with a reduced diameter end portion 38 adapted to be coaxially received within sprocket 27 to permit flange 30 to abut an annular shoulder 39 at the axially outer end of the reduced portion 38 and to help hold the sprocket concentric with the shaft.

At its axially outer end, the carrier is provided with an annular recess 50 and an outturned flange shoulder 40 together defining a string guard at the outboard end of the beater brush structure.

Bearing mount 17 includes a bearing housing portion 41 receiving a bearing 42 which, as seen in FIG. 2, journals the axle end 24 for rotation of the beater brush structure within nozzle portion 13. Housing portion 41 includes a transverse outer end wall 43 provided with an inturned flange 44 for cooperating with carrier string guard flange 40 in defining the string guard at the outboard end of the beater brush structure. The radially projecting tabs 45 hold the bearing housing structure in place.

As further seen in FIGS. 4 and 5, edge brush assembly 34 and sprocket 27 are secured to the end of the dowel 18, such as end 22 as seen in FIG. 4, by securing elements generally designated 46 comprising a pair of screws extending through suitable openings 47 in carrier 35, end openings 48 in sprocket portion 29, and into threaded engagement with the end of the dowel 18 in suitable threaded openings 49 therein. Thus, beater brush structure 14 effectively defines a pair of cylindrical elements, such as dowel 18 and carrier 35, each having brush tufts projecting therefrom, a sprocket 27, and means 46 for clamping the sprocket coaxially between the cylindrical elements. The cylindrical element 35, as disclosed, had a length which is only a small fraction of the length of the cylindrical element 18. Thus, the dowel provides the roller for the main beater brush structure of the assembly and the carrier 35 defines the support for the relatively short edge beater brush assembly.

In the illustrated embodiment, the sprocket portion 29 may comprise a molded element for facilitated manufacture. In the illustrated embodiment, the axle 24 extends through a suitable axial opening 71 in the sprocket portion 29 and an axial opening 72 in the carrier 35 for coaxially mounting the sprocket and carrier for rotation in the bearing 42. As shown in FIG. 4, a similar bearing 42 is provided at the opposite end of the dowel for receiving axle 23 and thereby journaling the opposite end of the beater brush assembly.

In the illustrated embodiment, the edge brush assembly tufts are equiangularly spaced about the axis of carrier 35, and more specifically, two pairs of tufts 36 are spaced apart approximately 120° circumferentially thereabout, with the beater bar 37 being spaced 120° between the pair of tufts 36 so that the tufts 36, and the beater bar 37, are respectively aligned with the helical brush strips 19 and the beater bar strip 20 of dowel 18. As seen in FIG. 4, the helical strips 19 and 20, and the tufts 36 and bar 37 are arranged to extend at an angle of approximately 7° to the axial plane of the carrier.

In the illustrated embodiment, the main beater brush assembly on dowel 18 utilizes formed brush and beater bar strips whereas the edge assembly 34 utilizes integral beater bar means and brush tufts mounted directly in the carrier 35.

In the illustrated embodiment, the two portions of the sprocket assembly are maintained in operative association with each other by the clamping of the sprocket to the end of the dowel by the carrier 35, as discussed above.

As indicated above, the invention comprehends the provision in the beater brush assembly of improved string guard means for preventing movement or migration of string picked up by the rotating brush elements into the bearings and/or sprocket. Thus as seen in FIGS. 5 and 6, a first string guard generally designated 51 is provided at the lefthand end of the assembly, as seen in FIG. 5. As shown, the string guard includes an annular guard member 52 having an end flange 53 provided with a radially inturned distal flange portion 54. Dowel end 21, as seen in FIG. 4, is provided with an annular groove 55 which receives the inturned distal end 54 of the string guard member 52. Thus, as seen in FIG. 6, the distal end surface 56 of the flange end 54 cooperates with the cylindrical outer surface 57 of the dowel end 21 to define and annular space 58 in which string may move from the brush tufts during rotation of the beater brush assembly. During rotation of the brush assembly string in the space 58 adjacent dowel surface 57 is at a lower energy level than it would have radially outwardly thereof as at the radially outer end of the surface 56. Resultingly, string moving axially outwardly toward the lefthand end bearing 42 is received in the string guard space 58 and substantially retained against further outward movement to the bearing.

A string guard 60 is provided at the right hand end of the brush assembly, as seen in FIG. 5 for preventing movement of string picked up by the brush tufts to the righthand bearing 42. More specifically, as seen in FIG. 9, the righthand string guard 60 is defined by the radial flange 40 and the adjacent annular recess 50. Recess 50 thusly defines an annular space wherein string received therein during rotation of the brush assembly has a lower energy level than that of string moving radially outwardly to the radially outer end of the flange 40. As the string similarly seeks the lowest available energy level, the string is effectively retained or captured in the annular recess 50 to prevent damage to the righthand bearing 42.

As seen in FIGS. 5, 7 and 8, additional string guards are provided at opposite sides of the sprocket 27.

More specifically, the sprocket string guards include a first string guard generally designated 61 at the lefthand side of the sprocket, and a second spring guard 62 at the righthand side thereof. String guard 61 is defined by a beveled end surface 63 on the righthand end of the dowel end portion 22, a reversely beveled surface 64 on the lefthand end of the sprocket portion 31, and the radially outwardly projecting flange 32 on the sprocket portion 31.

String guard 62 is defined by the flange 30 of the sprocket portion 29, a beveled end surface 65 extending axially outwardly therefrom, and a complementary surface 66 on the lefthand end of the carrier 35.

As shown, the axially inner surface 67 of flange 32 is radially planar and the axially outer surface 68 of flange 30 is radially planar.

Thus, string guard 61 is effectively defined by an annular recess space 69 wherein string moving thereto from the brush tufts during rotation of the brush assembly is at a minimum energy level as compared to the adjacent surfaces of the brush assembly. Similarly, string guard 62 is defined by an annular space 70 wherein string received from the edge brush assembly 34 during rotation of the brush assembly is at a minimum energy level as compared to the surfaces adjacent the annular space. Thus, the annular spaces 69 and 70 cooperate with the radially projecting flanges 30 and 32 in effectively preventing migration of string from the brush tufts into the cog belt **27*a* or onto the sprocket teeth 28**, thereby providing improved long troublefree life of the brush assembly.

The foregoing disclosure of specific embodiments is illustrative of the broad inventive concepts comprehended by the invention.

We claim:

1. In a vacuum cleaner brush having a cylindrical support carrying brush tufts and defining longitudinally opposite ends, and bearing means at said opposite ends for journaling the support for rotation about its longitudinal axis, the improvement comprising a string guard at said opposite ends for preventing movement of string on said support outwardly to said bearing means, said string guard means comprising means at said ends defining spaces wherein string received therein has a lower energy level than that of string adjacent thereto whereby the tendency of string picked up by the rotating brush to seek the lowest available energy level causes the string to be effectively captured in said spaces.

2. The vacuum cleaner brush structure of claim 1 wherein said string guard spaces comprise annular recesses disposed coaxially of said support.

3. The vacuum cleaner brush structure of claim 1 wherein said string guard spaces comprise annular recesses disposed coaxially of said support and having radially planar longitudinally outer wall surface portions for effectively precluding movement of the string longitudinally outwardly from the recesses.

4. The vaccum cleaner brush structure of claim 1 wherein said string guard spaces comprise annular recesses disposed coaxially of said support and having sloped longitudinally inner wall surfaces for guiding string longitudinally outwardly and radially inwardly into the recesses in assisting the string to find the lowest energy level thereof.

5. The vacuum cleaner brush structure of claim 1 wherein at least one of said string guards is defined by an annular wall fixed to an end of the support.

6. The vacuum cleaner brush structure of claim 1 wherein at least one of said string guard spaces is formed integrally in an end of the support.

7. The vacuum cleaner brush structure of claim 1 wherein said support includes an end member having a flange and an annular recess adjacent said flange defining one of said string guard spaces.

8. The vacuum cleaner brush structure of claim 1 further including at least one additional string guard space longitudinally inwardly adjacent one of said support ends.

9. In a vacuum cleaner brush having a cylindrical support carrying brush tufts and sprocket means for engagement by a drive belt for effecting rotation of the brush about its longitudinal axis, the improvement comprising a string guard at said opposite sides of said sprocket means for preventing movement of string on said support into said sprocket means, said string guard means defining spaces adjacent said sprocket means wherein string received therein has a lower energy level than that of string adjacent thereto whereby the tendency of string picked up by the rotating brush to seek the lowest available energy level causes the string to be effectively captured in said spaces.

10. The vacuum cleaner brush structure of claim 9 wherein said string guard spaces comprise annular recesses disposed coaxially of said support.

11. The vacuum cleaner brush structure of claim 9 wherein said string guard spaces comprise annular recesses disposed coaxially of said support and having radially planar wall surface portions adjacent the sprocket means for effectively precluding movement of the string longitudinally from the recesses to said sprocket means.

12. The vacuum cleaner brush structure of claim 9 wherein said string guard spaces comprise annular recesses disposed coaxially of said support, and having sloped opposite wall surfaces for guiding string longitudinally into the recesses in assisting the string to find the lowest energy level thereof.

13. The vacuum cleaner brush structure of claim 9 wherein said string guard spaces comprise annular recesses disposed coaxially of said support and having radially outer planar wall surface portions and sloped radially inner wall surface portions adjacent the sprocket means for effectively precluding movement of the string longitudinally from the recesses to said sprocket means.

14. The vacuum cleaner brush structure of claim 9 wherein said sprocket means is coaxially mounted to one end of said support and includes a toothed portion having an integral side flange, and an annular member defining an opposite side flange, the toothed portion extending between said side flanges, said side flanges defining only the annular sidewalls of the spaces adjacent said toothed portion.

15. The vacuum cleaner brush structure of claim 9 wherein said sprocket means is coaxially mounted to one end of said support and includes a toothed portion having an integral side flange, and an annular member defining an opposite side flange, the toothed portion extending between said side flanges, said side flanges defining only the annular sidewalls of the spaces adjacent said toothed portion, said brush further having an end brush outwardly of one of said flanges and defining the outer surface of the space defined inwardly by said one flange.

16. The vacuum cleaner brush structure of claim 9 wherein said sprocket means is coaxially mounted to one end of said support and includes a toothed portion having an integral side flange, and an annular member defining an opposite side flange, the toothed portion extending between said side flanges, said side flanges defining only the annular sidewalls of the spaces adjacent said toothed portion, said support defining a beveled end surface adjacent one of said flanges and defining the inner surface of the space defined outwardly by said one flange.

17. The vacuum cleaner brush structure of claim 9 wherein said sprocket means is coaxially mounted to one end of said support and includes a toothed portion having an integral side flange, and an annular member defining an opposite side flange, the toothed portion extending between said side flanges, said side flanges defining only the annular sidewalls of the spaces adjacent said toothed portion, said flanges further defining curved annular surfaces facing toward said toothed portion for guiding a drive belt into engagement with the toothed portion.

* * * * *